US011666123B2

(12) United States Patent
Li

(10) Patent No.: US 11,666,123 B2
(45) Date of Patent: Jun. 6, 2023

(54) MAGNETIC BUCKLE

(71) Applicant: LIAN YANG PLASTIC (SHENZHEN) CO., LTD., Guangdong (CN)

(72) Inventor: Qiuzong Li, Guangdong (CN)

(73) Assignee: LIAN YANG PLASTICS (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 17/702,842

(22) Filed: Mar. 24, 2022

(65) Prior Publication Data

US 2022/0330664 A1 Oct. 20, 2022

(30) Foreign Application Priority Data

Apr. 18, 2021 (CN) ..... 202110415373.5

(51) Int. Cl.
*A44B 11/25* (2006.01)

(52) U.S. Cl.
CPC ..... *A44B 11/258* (2013.01); *A44D 2203/00* (2013.01)

(58) Field of Classification Search
CPC ..... A44B 11/258; A42B 3/04; A42B 3/08; A43C 11/00; A44D 2203/00
See application file for complete search history.

(56) References Cited

U.S. PATENT DOCUMENTS

| | | | | |
|---|---|---|---|---|
| 8,739,371 | B2 * | 6/2014 | Fiedler | A45C 13/1069 24/303 |
| 9,307,797 | B2 * | 4/2016 | Sánchez Giráldez | A41F 1/002 |
| 9,555,935 | B2 * | 1/2017 | Fiedler | A44B 11/258 |
| 9,936,772 | B2 * | 4/2018 | Paik | A44B 11/2588 |
| 10,085,521 | B2 * | 10/2018 | Chen | A45C 13/1069 |
| 10,758,019 | B2 * | 9/2020 | Paik | A45C 13/1069 |
| 11,076,652 | B2 * | 8/2021 | Fiedler | A43C 11/00 |
| 11,324,295 | B2 * | 5/2022 | Paik | A44B 11/258 |
| 11,425,969 | B2 * | 8/2022 | Li | A44B 11/258 |
| 11,478,050 | B2 * | 10/2022 | Fiedler | A44B 11/25 |
| 2012/0044031 | A1 * | 2/2012 | Ninomiya | A44C 5/2085 335/219 |
| 2014/0277103 | A1 * | 9/2014 | Esposito | A61B 17/1327 24/303 |
| 2022/0322795 | A1 * | 10/2022 | Chen | A44B 11/2526 |

* cited by examiner

*Primary Examiner* — Robert Sandy
*Assistant Examiner* — Louis A Mercado

(57) ABSTRACT

A magnetic buckle, including a female buckle and a male buckle, the female buckle provided with a first magnetic member; the male buckle provided with a second magnetic member; the second magnetic member and the first magnetic member attract each other, characterized in that, the female buckle is provided with a locking member that can lock the male buckle so that the male buckle and the female buckle are locked and connected together, the locking member is provided with a third magnetic member, and the third magnetic member interacts with the second magnetic member and/or the first magnetic member through magnetic force so that it can actuate the locking member to lock the male buckle when the male buckle is mated with the female buckle.

11 Claims, 8 Drawing Sheets

MAGNETIC BUCKLE

CROSS REFERENCE TO RELATED APPLICATIONS

The present application claims the benefit of Chinese Patent Application No. 202110415373.5 filed on Apr. 18, 2021, the contents of which are incorporated herein by reference in their entirety.

TECHNICAL FIELD

The invention relates to a safety buckle, in particular to a magnetic buckle.

BACKGROUND

A safety buckle usually includes a female buckle and a male buckle, wherein the male buckle is provided with a locking tongue, and the female buckle is provided with a locking hole, the locking tongue can be inserted into the locking hole to lock the male buckle and the female buckle together. By operating unlocking, the male buckle and the female buckle can be separated from each other.

Generally, the locking hole on the female buckle is usually composed of a fixing hole and a locking portion which position can be changed. When the locking portion protrudes into the fixing hole, it can play a locking role to lock the locking tongue in the locking hole, so that the male buckle and the female buckle are locked and connected. When the locking portion exits the fixing hole, the locking tongue can freely enter and exit the fixing hole and withdraw from the locking hole, so that the male buckle can be separated from the female buckle.

When the male buckle and the female buckle are mated, the locking tongue usually squeezes the locking portion; the locking portion can be moved away by the squeezing of the locking tongue to make the locking tongue continue to advance; and when the locking tongue is fully inserted into the locking hole, the locking portion needs to automatically move back to the original state to lock the locking tongue and realize the locking connection between the male buckle and the female buckle. Therefore, when the locking tongue is inserted into the locking hole, the locking portion needs to automatically return to the original position for locking after being passively removed. Therefore, in the existing safety buckle, the female buckle needs to be provided with an elastic member, and the elastic force of the elastic member is used to provide an opportunity for the movement of the locking portion, so that the locking portion can be pushed by the locking tongue, and the elasticity of the elastic member is used to realize the automatic locking of the locking portion.

In the existing safety buckle, no matter what its internal structure is, but without exception, all need to be provided with elastic members. However, the elastic member is provided in the female buckle to realize the movement and automatic locking of the locking portion, and a large installation space in the female buckle is needed to be able to install the elastic member. Therefore, this determines that the existing safety buckle has a certain degree of size, it cannot be further miniaturized. In some places of use, smaller safety buckles can better meet the needs, for example, safety buckles used on safety helmets, and safety buckles used on shoe buckles. Therefore, the safety buckle that can realize the basic functions of the existing safety buckle and can meet the needs of miniaturization has a wider application range and is worthy of study.

SUMMARY OF THE INVENTION

The present invention aims to solve the above-mentioned problems, and provides a magnetic buckle which is not provided with an elastic member and uses the magnetic force of the magnetic member to realize the movement and locking of the locking portion, thereby saving installation space and conducive to miniaturization.

In order to solve the above problems, the present invention provides a magnetic buckle, including a female buckle and a male buckle, the female buckle provided with a first magnetic member; the male buckle provided with a second magnetic member; the second magnetic member and the first magnetic member attracted to each other in the locking direction of the male buckle and the female buckle, and the male buckle and the female buckle mating and locking together in the locking direction; characterized in that, the female buckle is provided with a locking member that can lock the male buckle so that the male buckle and the female buckle are locked and connected together, the locking member is provided with a third magnetic member, and the third magnetic member interacts with the second magnetic member and/or the first magnetic member through magnetic force so that it can actuate the locking member to lock the male buckle when the male buckle is mated with the female buckle.

Further, the male buckle is provided with a protruding locking tongue; the female buckle is provided with a fixing hole for free entry and exit of the locking tongue, and the locking member is provided with a locking portion that can protrude within the range of the fixing hole so as to lock the locking tongue; when the locking tongue is inserted into the fixing hole, the third magnetic member interacts with the second magnetic member and/or the first magnetic member through magnetic force so that it can actuate the locking portion to protrude within the range of the fixing hole so as to lock the locking tongue.

Further, the third magnetic member and the first magnetic member can attract or repel each other, and actuate the locking member to reset when the male buckle and the female buckle are separated from each other.

Further, the third magnetic member and the first magnetic member can attract or repel each other so that the locking portion can protrude within the range of the fixing hole when the male buckle and the female buckle are in a separated state.

Further, the locking member is a rigid structure, and the position of the third magnetic member relative to the locking member is fixed.

Further, the third magnetic member and the locking portion are arranged on the same side of the fixing hole.

Further, the third magnetic member and the locking portion are arranged on opposite sides of the fixing hole.

Further, the third magnetic member and the first magnetic member repel each other, and when the locking tongue enters the fixing hole, the second magnetic member attracts the third magnetic member to make the locking portion move towards the locking tongue to lock the locking tongue.

Further, the third magnetic member attracts the first magnetic member to make the locking portion protrude within the range of the fixing hole when the male buckle and the female buckle are in a separated state; when the locking tongue enters the fixing hole, the force of the second magnetic member attracting the first magnetic member and repelling the third magnetic member can cause the locking tongue to push the locking portion to move in the locking direction; when the locking tongue moves to the locked position along the locking direction, the first magnetic member and the third magnetic member are attracted to make the locking portion move towards the locking tongue to lock the locking tongue.

Further, the third magnetic member and the first magnetic member are attracted to each other so that the locking portion is located outside the range of the fixing hole when the male buckle and the female buckle are in a separated state; when the locking tongue enters the fixing hole, the second magnetic member repels the third magnetic member so that the locking portion moves towards the locking tongue to lock the locking tongue.

Further, the third magnetic member repels the first magnetic member, so that the locking portion protrudes within the range of the fixing hole when the male buckle and the female buckle are in a separated state; when the locking tongue enters the fixing hole, the force of the second magnetic member attracting the first magnetic member and the third magnetic member can cause the locking tongue to push the locking portion to move in the locking direction; when the locking tongue moves in the locking direction to the locked position, the first magnetic member and the third magnetic member repel each other so that the locking portion can move towards the locking tongue to lock the locking tongue.

The beneficial contribution of the present invention is that it effectively solves the above-mentioned problems. The magnetic buckle of the present invention replaces the elastic member in the prior art with a third magnetic member, and uses the third magnetic member to interact with the existing magnetic members in the male and female buckles to realize the actuation of the locking element, so that the locking member can be locked, further the male buckle can be locked. The present invention can greatly simplify the structure of the locking member by replacing the elastic member with the third magnetic member, and can reduce the volume of the locking member, so as to facilitate the miniaturization of the structure and expand the scope of application. The magnetic buckle of the present invention has the characteristics of novel structure and practical function, and has strong practicability and should be promoted vigorously.

Figure 1:
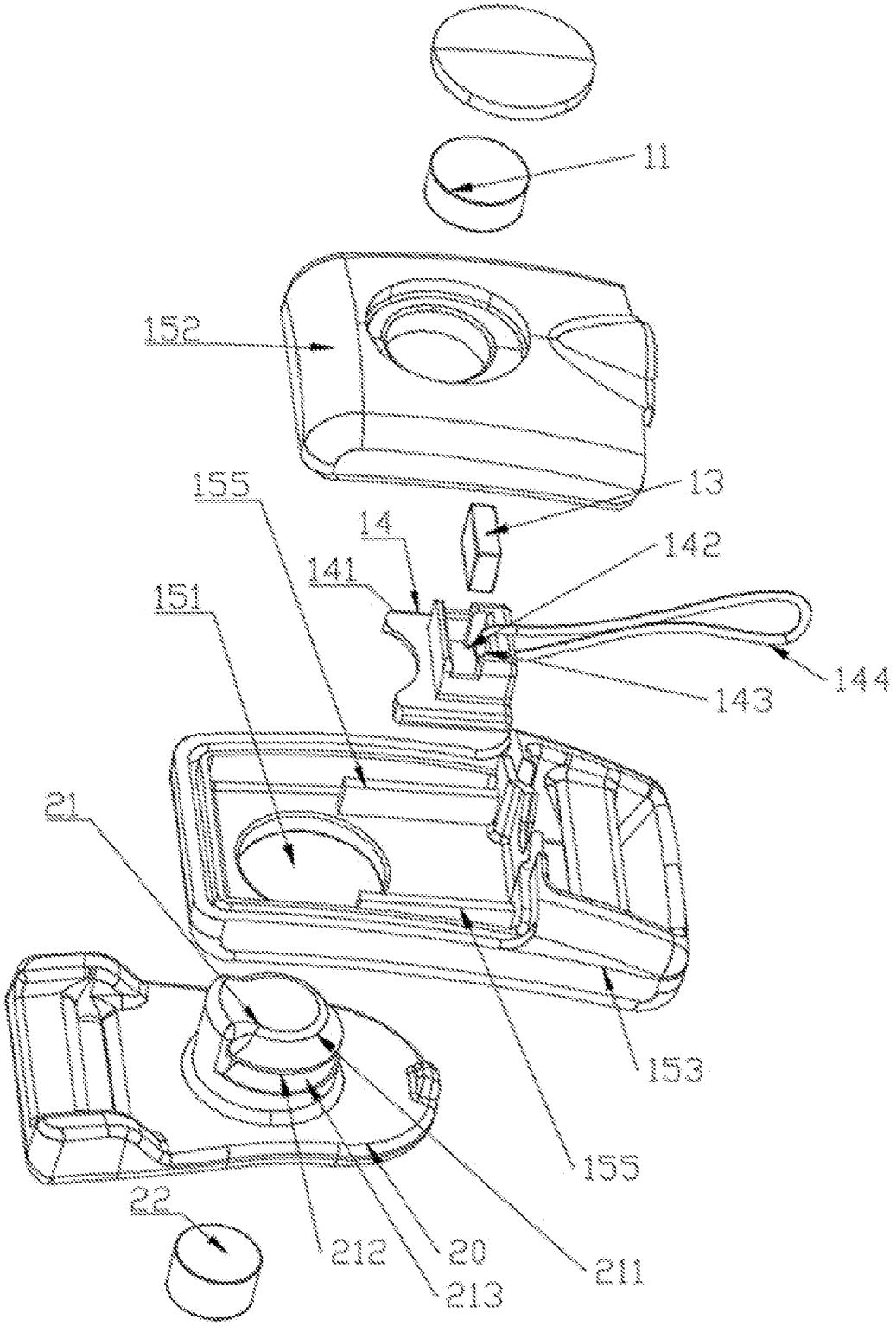
FIG. 1 is a schematic diagram of the structure of the first embodiment.

Reference signs: female buckle 10, first magnetic member 11, locking hole 12, third magnetic member 13, locking member 14, locking portion 141, inclined curved surface 1411, mounting position 142, pull hole 143, draw rope 144, housing 15, fixing hole 151, first housing 152, second housing 153, magnet frame 154, limiting portion 155, male buckle 20, locking tongue 21, first conical surface 211, groove portion 212, second conical surfaces 213, second magnetic member 22.

EMBODIMENTS OF THE INVENTION

The following examples are further explanations and supplements to the present invention, and do not constitute any limitation to the present invention.

As shown in FIGS. 1-10, the magnetic buckle of the present invention includes a male buckle 20 and a female buckle 10. The main point is that the female buckle 10 is not provided with a traditional elastic member, but is provided with a third magnetic member 13. The interaction between the third magnetic member 13 and the magnetic members in the male buckle 20 and the female buckle 10 is used to realize the movement and locking of the locking portion 141, thereby simplifying the structure, reducing the installation space, and facilitating the miniaturization of the structure.

As shown in FIGS. 2, 3, 7, and 8, the male buckle 20 and the female buckle 10 can be locked and connected together and can be separated from each other. The male buckle 20 is provided with a locking tongue 21, and the female buckle 10 is provided with a corresponding locking hole 12. The locking tongue 21 can be inserted into the locking hole 12 along the locking direction X so that the male buckle 20 and the female buckle 10 are locked and connected together. When the unlocking operation is performed, the locking tongue 21 can withdraw from the locking hole 12 to separate the male buckle 20 and the female buckle 10 from each other.

As shown in FIGS. 1 to 10, the female buckle 10 is provided with a first magnetic member 11, and the male buckle 20 is provided with a second magnetic member 22. The first magnetic member 11 and the second magnetic member 22 are attracted to each other in the locking direction of the male buckle 20 and the female buckle 10. When the male buckle 20 and the female buckle 10 are close to a certain distance, the first magnetic member 11 and the second magnetic member 22 are attracted to each other so that the locking tongue 21 can be quickly inserted into the locking hole 12.

As shown in FIGS. 1 to 10, the position of the first magnetic member 11 corresponds to the position of the locking hole 12. The position of the second magnetic member 22 corresponds to the position of the locking tongue 21. Normally, the second magnetic member 22 is arranged in the locking tongue 21.

The shape of the first magnetic member 11 and the second magnetic member 22 is not limited, and they are preferably the same in shape. In this embodiment, the first magnetic member 11 and the second magnetic member 22 are circular magnets.

As shown in FIGS. 1 to 10, for locking the locking tongue 21, and a locking member 14 is provided in the female buckle 10. The locking member 14 is movably arranged in the female buckle 10 and can move in the female buckle 10.

Figure 2:
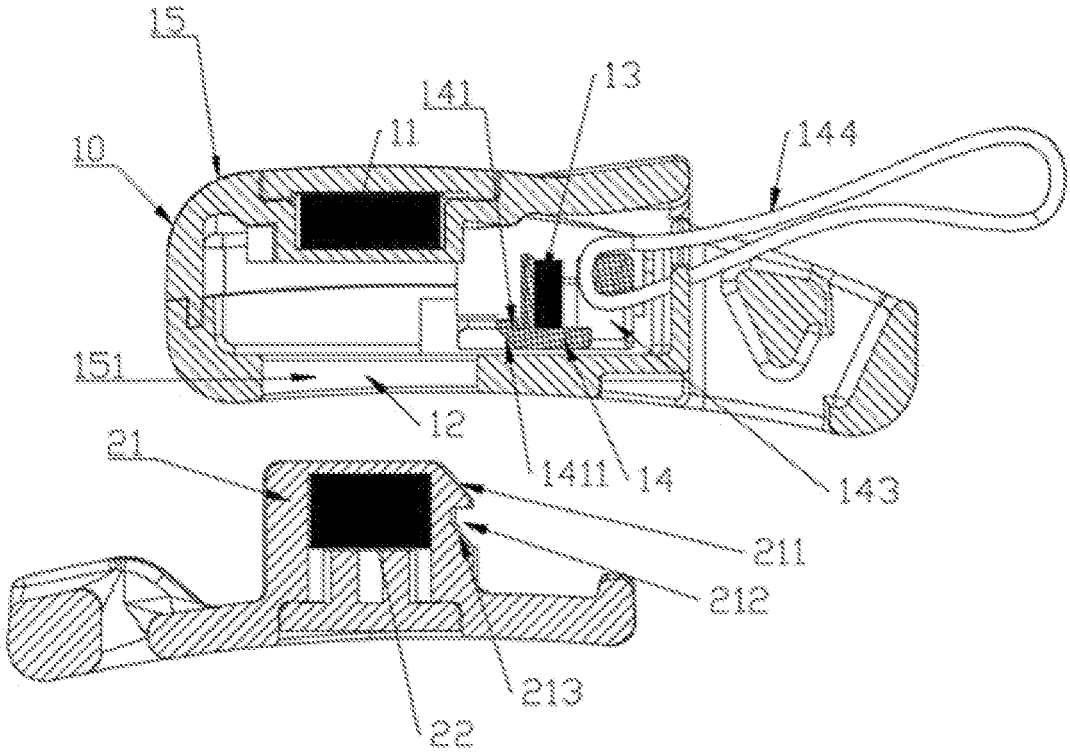
FIG. 2 is a cross-sectional view of the male buckle and the female buckle of the first embodiment when they are separated.
Figure 3:
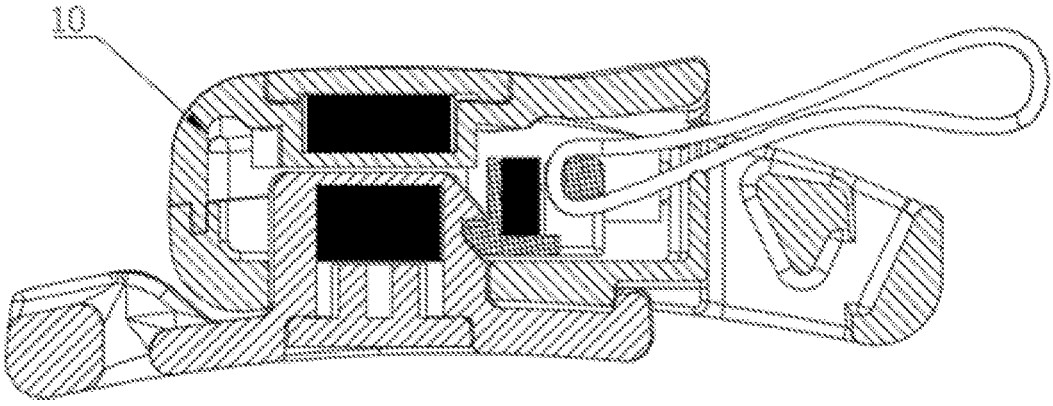
FIG. 3 is a cross-sectional view of the male buckle and the female buckle of the first embodiment when they are locked.
Figure 5:
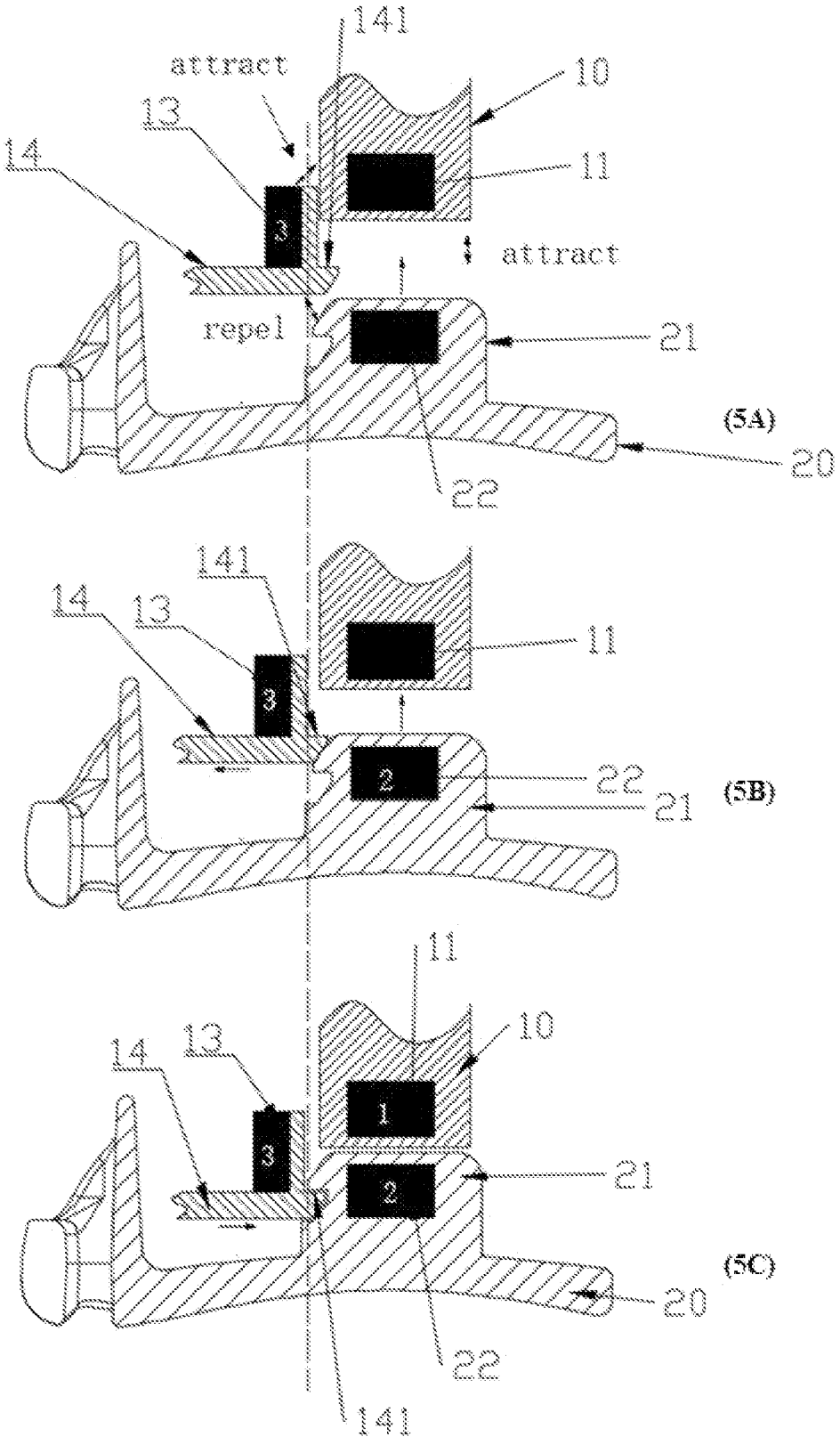
FIG. 5 is a schematic diagram of the principle of the third embodiment, wherein, 5A is a schematic diagram when the locking tongue is not inserted, 5B is a schematic diagram of the locking tongue insertion process, and 5C is a schematic diagram of the locking portion locking the locking tongue.
Figure 6:
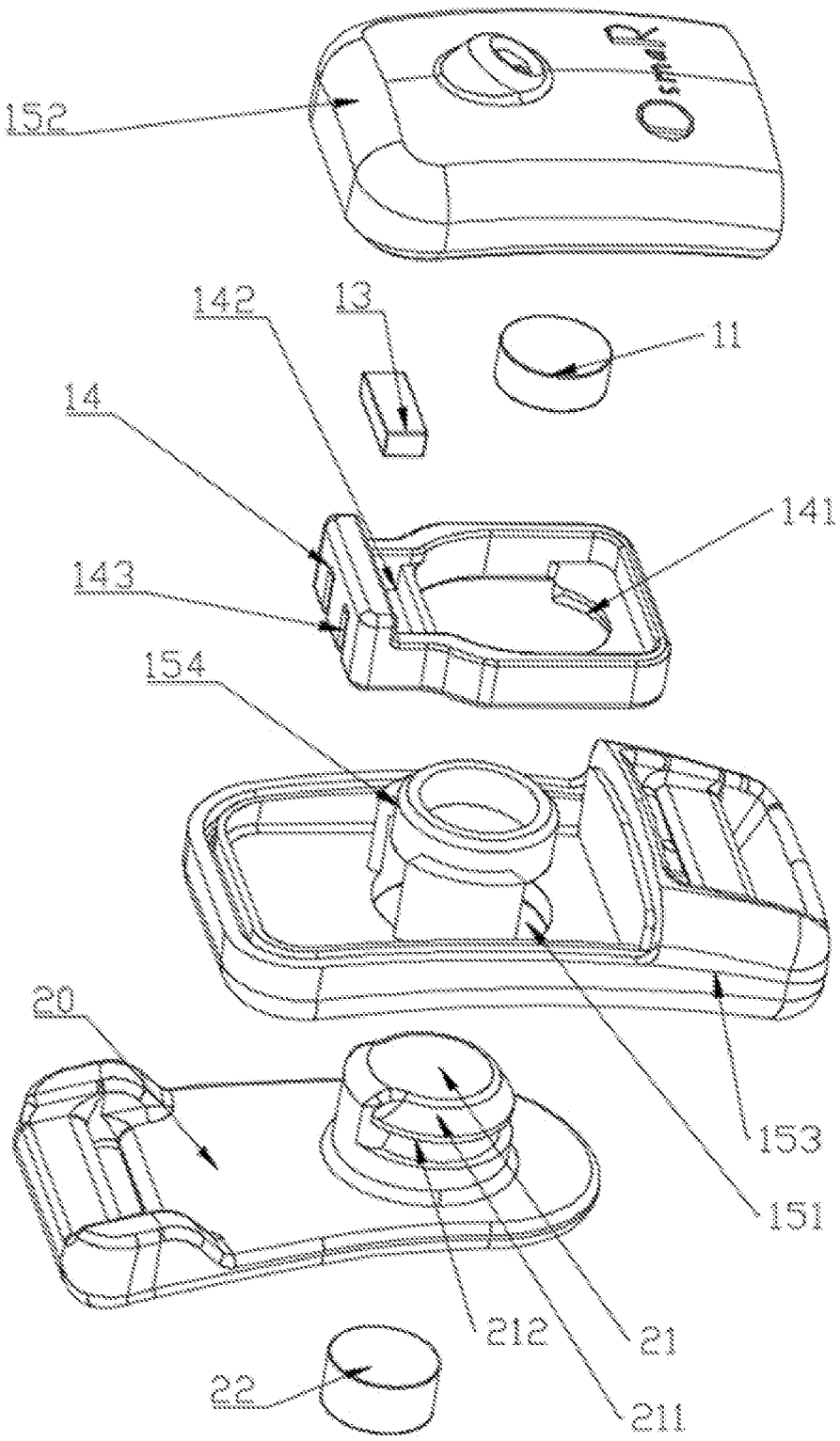
FIG. 6 is a schematic diagram of the structure of the fourth embodiment.
Figure 7:
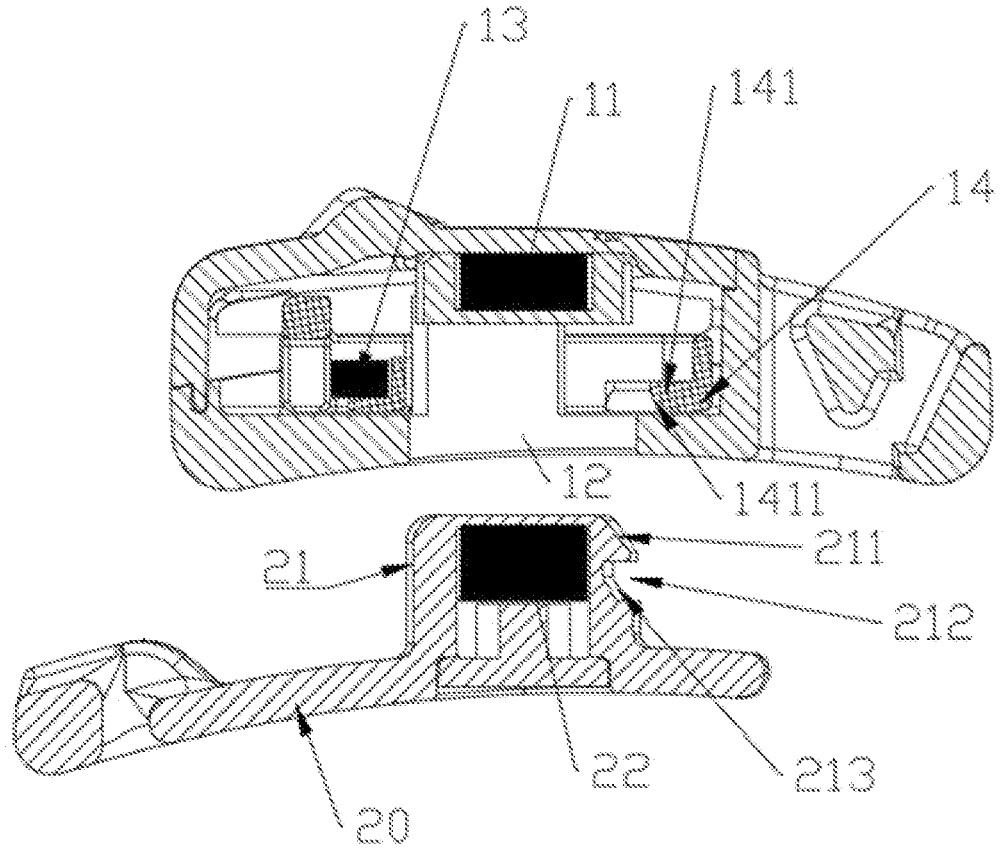
FIG. 7 is a cross-sectional view of the male buckle and the female buckle of the fourth embodiment when they are separated.
Figure 8:
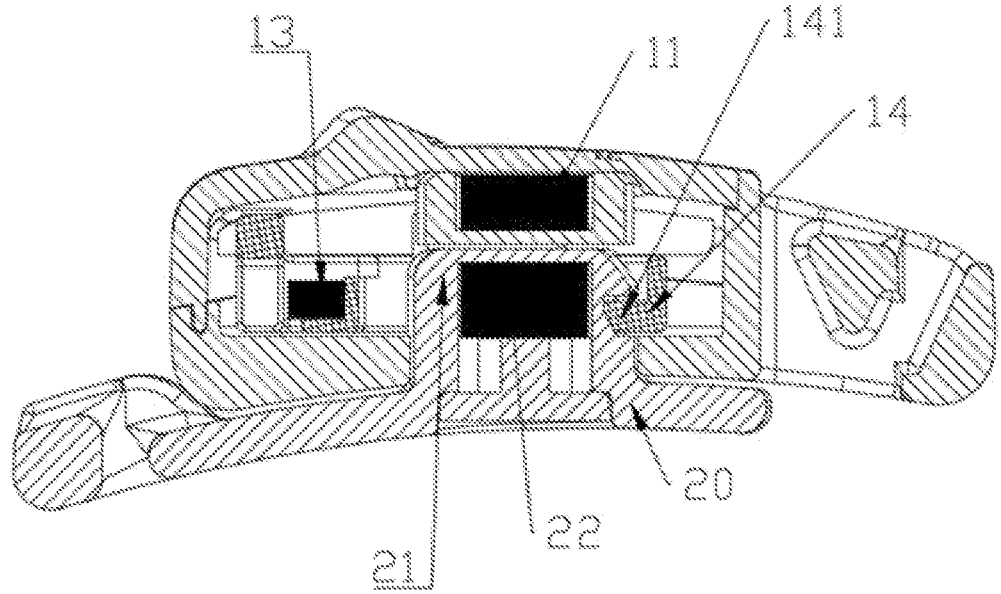
FIG. 8 is a cross-sectional view of the male buckle and the female buckle of the fourth embodiment when they are locked.

As shown in FIGS. 1 to 10, the locking member 14 is provided with a locking portion 141. The locking portion 141 is a part of the locking hole 12. A fixing hole 151 is provided in the female buckle 10, and the locking portion 141 and the fixing hole 151 jointly form a locking hole 12. The size of the fixing hole 151 should enable the locking tongue 21 to enter and exit freely. The locking hole 12 locks or releases the locking tongue 21 by changing the position of the locking portion 141. As shown in FIGS. 3 and 8, when the locking portion 141 protrudes within the range of the fixing hole 151, it has the ability to lock the locking tongue 21. At this time, the locking portion 141 can lock the locking tongue 21 so that the male buckle 20 and the female buckle 10 are locked and connected together. When the locking portion 141 moves in the direction of exiting the fixing hole 151 to a certain position, for example, completely exiting the range of the fixing hole 151, as shown in FIGS. 2 and 7, the locking portion 141 loses the ability of locking the locking tongue 21, while the male buckle 20 and the female buckle 10 can be separated from each other.

As shown in FIGS. 1 to 10, the locking portion 141 is not actuated by an elastic member, and a third magnetic member 13 is provided in the locking member 14. The position of the third magnetic member 13 relative to the locking member 14 is fixed. The third magnetic member 13 can interact with the second magnetic member 22 and/or the first magnetic member 11 through magnetic force to actuate the locking member 14 to lock the male buckle 20 when the male buckle 20 and the female buckle 10 are mated. In other words, when the locking tongue 21 is inserted into the fixing hole 151, the third magnetic member 13 interacts with the second magnetic member 22 and/or the first magnetic member 11 through magnetic force to actuate the lock portion 141 to protrude in the range of the fixing hole 151 to lock the locking tongue 21.

As shown in FIGS. 1 to 10, the locking member 14 is a rigid structure, and it is not provided with an elastic member that can act on the locking portion 141. The movement of the locking portion 141 to the locked state is realized only by the magnetic force between the third magnetic member 13 and the second magnetic member 22 and/or the first magnetic member 11. Therefore, it can greatly simplify the structure of the locking member 14, reduce the size of the female buckle 10, thereby facilitating the miniaturization of the structure.

In the default state, that is, when the male buckle 20 and the female buckle 10 are separated and not subjected to external force, the position of the locking portion 141 can be set to protrude within the range of the fixing hole 151, or it can also be set to not protrude within the range of the fixing hole 151. In the traditional safety buckle provided with elastic members, in the default state, the locking portion 141 must be set to protrude within the range of the fixing hole 151. When the locking member 14 is actuated by magnetic force, the default position of the locking portion 141 can be flexibly set.

Figure 10:
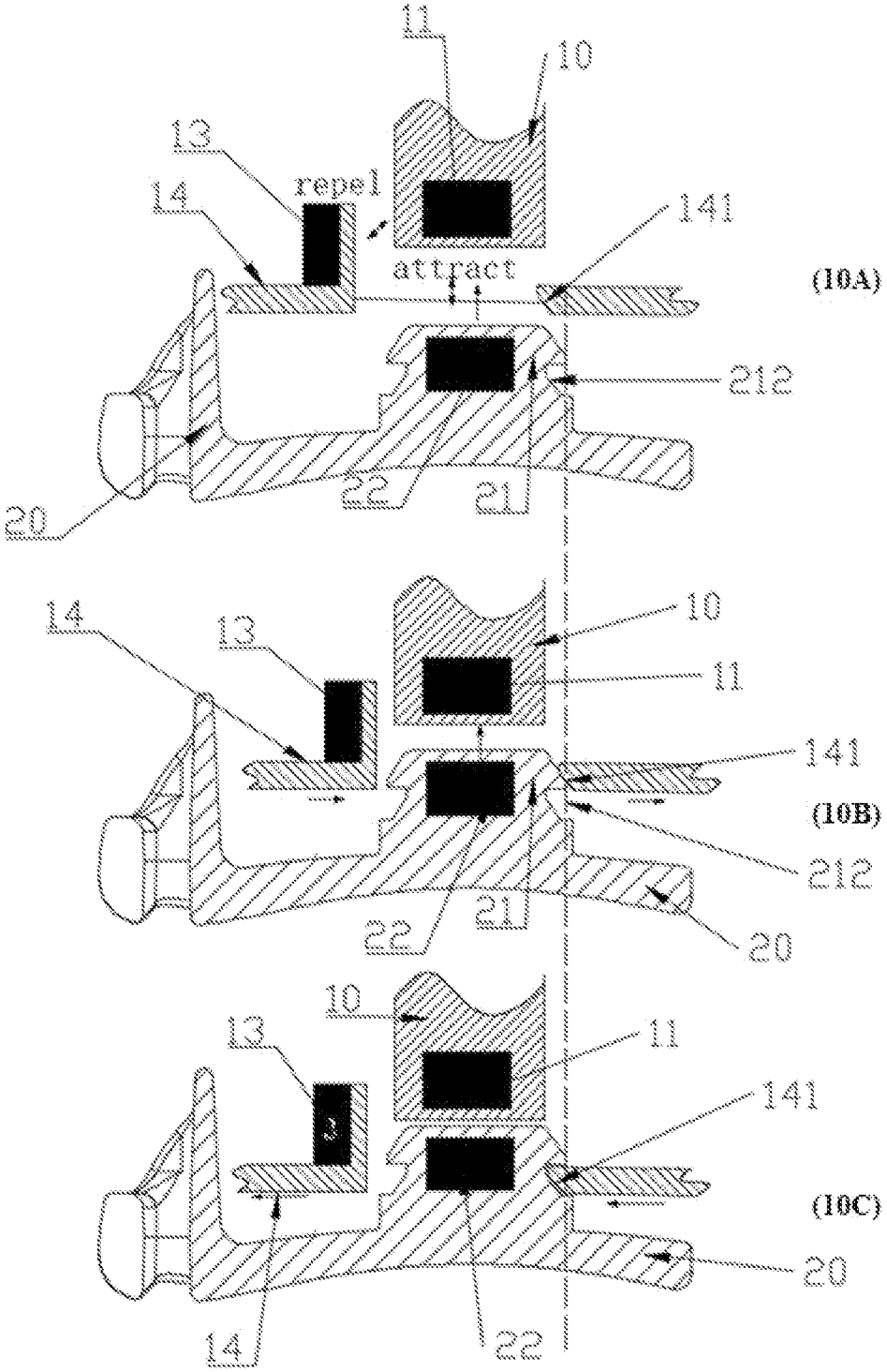
FIG. 10 is a schematic diagram of the principle of the fifth embodiment, wherein, 10A is a schematic diagram when the locking tongue is not inserted, 10B is a schematic diagram of the locking tongue insertion process, and 10C is a schematic diagram of the locking portion locking the locking tongue.

In some embodiments, in the default state, as shown in 5A of FIGS. 5 and 10A of FIG. 10, the locking portion 141 protrudes within the range of the fixing hole 151. The third magnetic member 13 and the first magnetic member 11 can attract or repel each other to keep the locking member 14 in a stable state and make the locking portion 141 protrude within the range of the fixing hole 151. When the locking tongue 21 needs to enter the locking hole 12, it needs to overcome the magnetic attraction or magnetic repulsion between the third magnetic member 13 and the first magnetic member 11 to push the locking portion 141, so that the locking portion 141 temporarily moves away so that the locking tongue 21 can continue to move forward.

Figure 4:
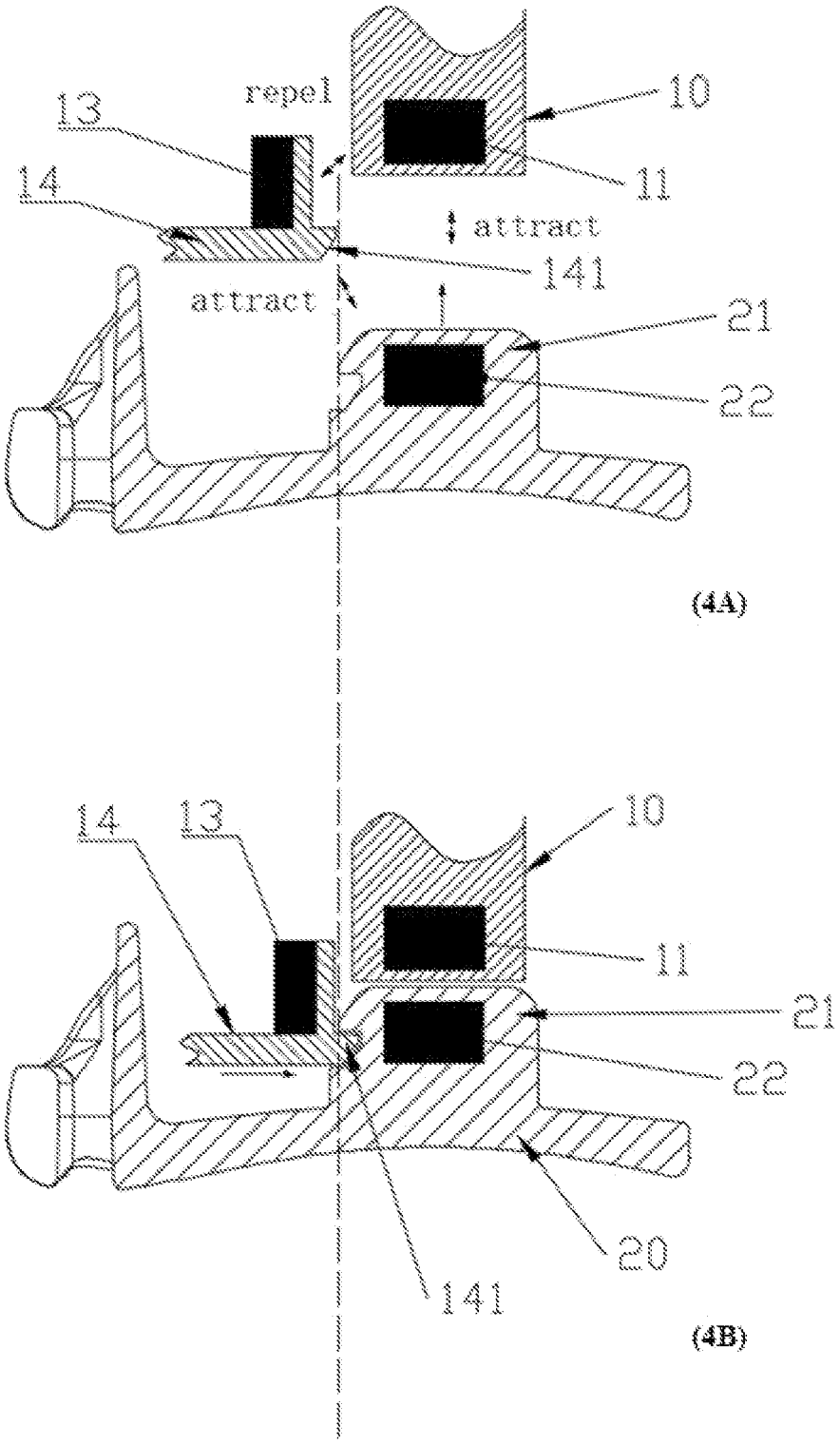
FIG. 4 is a schematic diagram of the principle of the first embodiment, wherein, 4A is a schematic diagram when the locking tongue is not inserted, and 4B is a schematic diagram of the locking portion locking the locking tongue.
Figure 9:
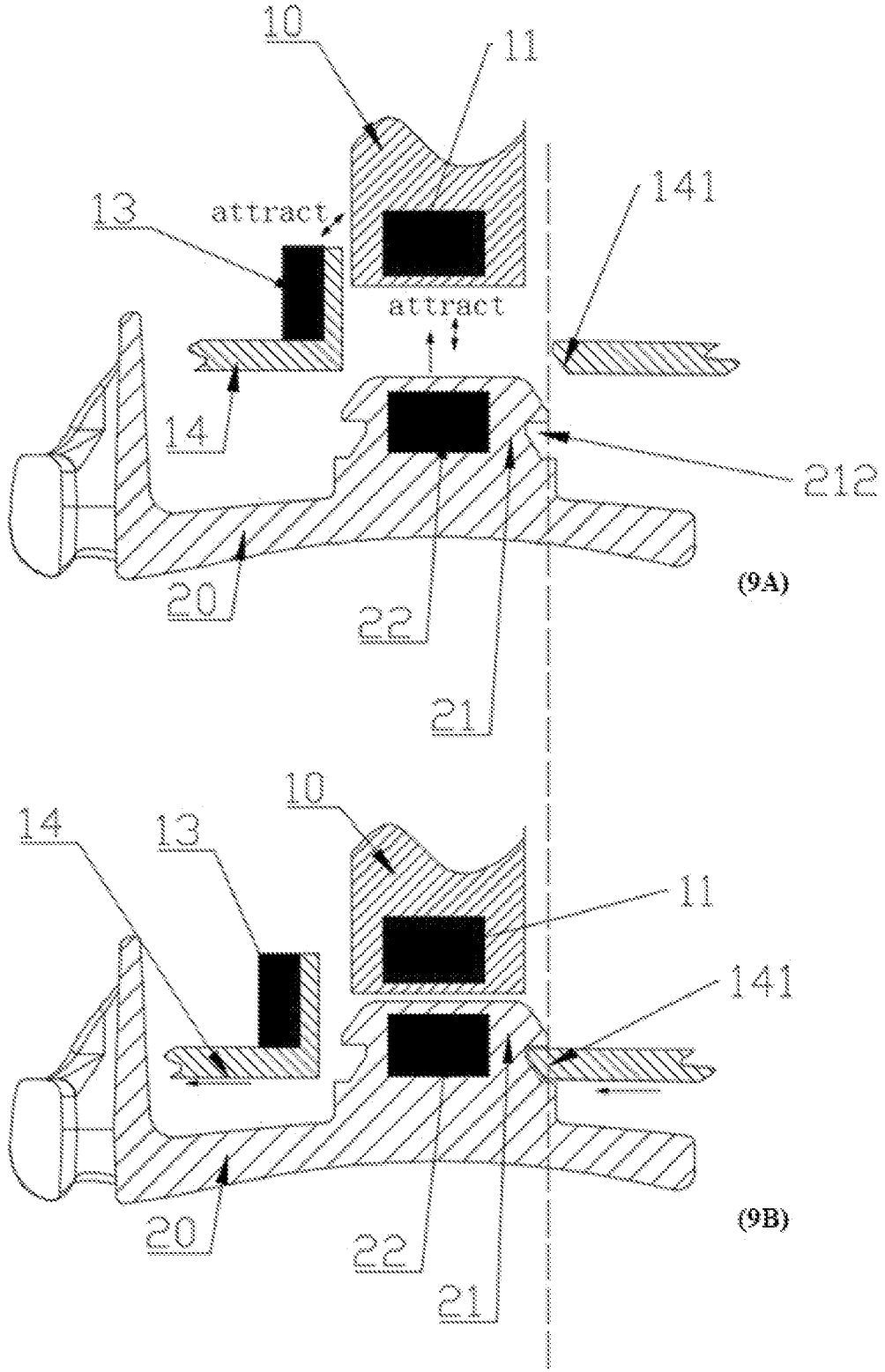
FIG. 9 is a schematic diagram of the principle of the fourth embodiment, wherein, 9A is a schematic diagram when the locking tongue is not inserted, and 9B is a schematic diagram of the locking portion locking the locking tongue.

In some embodiments, in the default state, as shown in 4A of FIGS. 4 and 9A of FIG. 9, the locking portion 141 does not protrude within the range of the fixing hole 151. The third magnetic member 13 and the first magnetic member 11 can attract or repel each other to keep the locking member 14 in a stable state, and the locking portion 141 does not protrude within the range of the fixing hole 151. When the locking tongue 21 needs to enter the locking hole 12, the locking tongue 21 can directly enter the locking hole 12 without pushing the locking portion 141 to move away. This is more convenient for the locking tongue 21 to enter and advantageous for the male buckle 20 and the female buckle 10 to quickly connect with the locking tongue 21.

When the locking tongue 21 enters the fixing hole 151, the second magnetic member 22 in the locking tongue 21 can interact with the third magnetic member 13. The third magnetic member 13 and the second magnetic member 22 can attract or repel each other. At this time, the first magnetic member 11, the second magnetic member 22, and the third magnetic member 13 interact with each other through magnetic force, so that the locking tongue 21 can be inserted into the locking hole 12, and the locking portion 141 can lock the locking tongue 21 so that the male buckle 20 and the female buckle 10 are locked and connected together.

The first magnetic member 11 and the second magnetic member 22 are attracted to each other to guide the locking tongue 21 into the locking hole 12. The third magnetic member 13 and the first magnetic member 11 and the second magnetic member 22 may attract or repel each other. When the third magnetic member 13 and the first magnetic member 11 are attracted to each other, the third magnetic member 13 and the second magnetic member 22 repel each other; when the third magnetic member 13 and the first magnetic member 11 repels each other, the third magnetic member 13 and the second magnetic member 22 attract each other.

The magnitude of the attraction and repulsion between the third magnetic member 13 and the first magnetic member 11 and the second magnetic member 22 can be set according to needs, and the final join force should be able to make the locking portion 141 of the locking member 14 lock the locking tongue 21 of the male buckle 20. In some embodiments, the attractive force between the third magnetic member 13 and the first magnetic member 11 and the second magnetic member 22 may be greater than the repulsive force, and the locking portion 141 is protruded within the range of the fixing hole 151 by attracting the third magnetic member 13, the locking tongue 21 is locked. In some embodiments, it may be that the repulsive force between the third magnetic member 13 and the first magnetic member 11 and the second magnetic member 22 may be greater than the attractive force, and the locking portion 141 is protruded within the range of the fixing hole 151 by repelling the third magnetic member 13, the locking tongue 21 is locked.

The third magnetic member 13 and the locking portion 141 may be distributed on the same side of the fixing hole 151 (as shown in FIGS. 4 and 5), or may be distributed on opposite sides of the fixing hole 151 (as shown in FIG. 9, FIG. 10).

As shown in FIGS. 4 and 5, when the third magnetic member 13 and the locking portion 141 are distributed on the same side of the fixing hole 151, the attractive force between the third magnetic member 13 and the first magnetic member 11 and the second magnetic member 22 should be greater than the repulsive force. The third magnetic member 13 is attracted by the first magnetic member 11 or the second magnetic member 22, so that the locking portion 141 protrudes within the range of the fixing hole 151 and the locking tongue 21 is locked.

As shown in FIGS. 9 and 10, when the third magnetic member 13 and the locking portion 141 are distributed on opposite sides of the fixing hole 151, the repulsive force between the third magnetic member 13 and the first magnetic member 11 and the second magnetic member 22 should be greater than the attractive force, and the locking portion 141 is protruded within the range of the fixing hole 151 by repelling the third magnetic member 13, the locking tongue 21 is locked. The third magnetic member 13 is repelled by the first magnetic member 11 or the second magnetic member 22, so that the locking portion 141 protrudes within the range of the fixing hole 151 and the locking tongue 21 is locked.

When the locking tongue 21 is inserted into the locking hole 12, the magnetic force among the first magnetic member 11, the second magnetic member 22, and the third magnetic member 13 can maintain the locked state, so that the male buckle 20 and the female buckle 10 are locked and connected together. When unlocking is required, the locking member 14 is forced to move in the female buckle 10 by external force, so that the locking portion 141 moves in the direction of exiting the fixing hole 151; when the locking portion 141 moves to a certain position, the locking tongue 21 can freely escape from the locking hole 12, thereby achieving unlocking.

The manner in which the locking member 14 is prompted to move by external force is not limited. For example, in some embodiments, the locking member 14 can be forced to move by pressing so that the locking portion 141 moves in the direction of exiting the fixing hole 151. In some embodiments, the locking member 14 can be forced to move by pulling outwards so that the locking portion 141 moves in the direction of exiting the fixing hole 151. In some embodiments, the locking member 14 can be forced to move by dialing so that the locking portion 141 moves in the direction of exiting the fixing hole 151. In some embodiments, the locking member 14 can be forced to move by rotating, so that the locking portion 141 moves in the direction of exiting the fixing hole 151.

After the locking tongue 21 freely escapes from the locking hole 12, when the external force is moved away, the magnetic force between the first magnetic member 11 and the third magnetic member 13 can actuate the locking member 14 to reset and keep the locking member 14 in a balanced position. The balance position can be such that the locking portion 141 protrudes within the range of the fixing hole 151, or it can be such that the locking portion 141 does not protrude within the range of the fixing hole 151, which is specifically determined based on the properties of the magnetic force between the third magnetic member 13 and the first magnetic member 11.

In order to describe the structure of the present invention more specifically, different embodiments are described below:

Embodiment 1

As shown in FIGS. 1 to 5, the male buckle 20 is provided with a locking tongue 21 and a second magnetic member 22.

As shown in FIGS. 1 to 5, the locking tongue 21 is in a protruding shape, and its end is in the shape of a truncated cone, and is provided with a first conical surface 211. The first conical surface 211 facilitates the locking tongue 21 to push the locking portion 141 into the locking hole 12. In order to achieve locking, a groove portion 212 is provided on the locking tongue 21, which is used to cooperate with the locking portion 141 to achieve a locked connection. The groove portion 212 is located slightly away from the end surface of the locking tongue 21. The groove portion 212 may be set in a ring shape, or may be set in a shape matching the shape and size of the locking portion 141. The groove portion 212 is provided with a second conical surface 213 matching the locking portion 141. When the locking tongue 21 pushes the locking portion 141 and squeezes into the locking hole 12, the locking portion 141 can be locked in the groove portion 212 so that the male buckle 20 and the female buckle 10 are locked and connected together.

As shown in FIGS. 1 to 5, the position of the second magnetic member 22 corresponds to the position of the locking tongue 21. In this embodiment, the second magnetic member 22 is provided in the locking tongue 21.

As shown in FIGS. 1 to 5, the female buckle 10 includes a housing 15, a locking member 14, a first magnetic member 11 and a third magnetic member 13.

As shown in FIGS. 1 to 5, the housing 15 is used to provide the locking member 14 and the first magnetic member 11, and the shape and structure of the housing 15 can be set according to requirements. Normally, in order to facilitate processing and assembling, it usually includes a first housing 152 and a second housing 153 that are butt-connected. When the first housing 152 and the second housing 153 are butt-connected together, an accommodating cavity is formed inside, which can be used to install the locking member 14 and the first magnetic member 11. In addition, in order to facilitate the installation of the first magnetic member 11, a magnet frame 154 can be provided inside the first magnetic member 11 as required.

As shown in FIG. 1, in order to facilitate the insertion of the locking tongue 21 of the male buckle 20 into the female buckle 10, the housing 15 is provided with the fixing hole 151. The shape of the fixing hole 151 can be set according to requirements. In this embodiment, it is a circular hole.

As shown in FIGS. 2 and 3, the position of the first magnetic member 11 in the female buckle 10 should be opposite to the position of the fixing hole 151, so as to facilitate the snap-action with the second magnetic member 22 in the locking tongue 21.

The locking member 14 is movably arranged in the housing 15. As shown in FIG. 1, the locking member 14 is provided with a locking portion 141 and a mounting position 142 for installing the third magnetic member 13.

As shown in FIGS. 1 to 5, the locking portion 141 and the mounting position 142 are both located on the same side of the fixing hole 151. As shown in FIG. 1, the locking portion 141 is in the shape of a plate, and the end thereof facing the fixing hole 151 is in the shape of an arc used to hold the locking tongue 21 and can be locked in the groove portion 212 of the locking tongue 21. In order to facilitate the locking tongue 21 to push the locking portion 141 into the locking hole 12, the arc-shaped end of the locking portion 141 is provided with an introduction inclined curved surface 1411. The introduction inclined curved surface 1411 facilitates the squeezing of the locking tongue 21 and squeezes it into the locking hole 12, so that the locking portion 141 can lock the locking tongue 21.

As shown in FIG. 1, the mounting position 142 has a groove structure, and can be used for clamping the third magnetic member 13. The shape and size of the mounting position 142 should match the shape and size of the third magnetic member 13. In this embodiment, the mounting position 142 is a rectangular slot, which can be used to hold a rectangular magnet block.

As shown in FIG. 1, in order to facilitate unlocking by actuating the locking member 14 by an external force, the locking member 14 may be provided with a corresponding operating part. In this embodiment, the locking member 14 is actuated to unlock by pulling outwards. Therefore, the locking member 14 is provided with a pull hole 143, which can be conveniently provided with a pull ring or a pull rope 144. When the pull ring or pull rope 144 is pulled outward, the locking member 14 moves in a direction away from the fixing hole 151. In other embodiments, corresponding operating parts can be provided according to different unlocking operating manners, so as to facilitate the user's operation to activate the locking member 14 for unlocking.

The third magnetic member 13 is disposed in the mounting position 142 of the locking member 14. The position of the third magnetic member 13 is fixed relative to the locking member 14. Since the locking member 14 is movably arranged in the housing 15, the third magnetic member 13 and the locking member 14 can move synchronously.

As shown in FIG. 1, in order to limit the movement path of the locking member 14, a corresponding limiting portion 155 may be provided on the inner wall of the housing 15. In this embodiment, the limiting portion 155 is in the shape of a protruding long block, and is parallel and spaced so that the locking member 14 can be restrained in it, so as to restrain the locking member 14 from moving in a straight line without deviation.

In this embodiment, the first magnetic member 11 and the second magnetic member 22 are circular magnets that attract each other. The third magnetic member 13 is a rectangular magnet and repels the first magnetic member 11; when the locking tongue 21 enters the locking hole 12, the third magnetic member 13 attracts the second magnetic member 22.

As shown in 4A of FIG. 4, in the default state, the first magnetic member 11 and the third magnetic member 13 repel so that the locking portion 141 is outside the range of the fixing hole 151.

When the male buckle 20 and the female buckle 10 are approached in the locking direction, the magnetic attraction force between the first magnetic member 11 and the second magnetic member 22 will cause the locking tongue 21 of the male buckle 20 to align with the locking hole 12 of the female buckle 10 and insert into it. Since the locking portion 141 is outside the range of the fixing hole 151, the locking tongue 21 can directly enters the locking hole 12 during the insertion process without pushing the locking portion 141, thereby particularly facilitating for inserting the male buckle 20 into the female buckle 10.

As shown in 4B of FIG. 4, when the locking tongue 21 enters the locking hole 12, the second magnetic member 22 and the third magnetic member 13 attract each other, and the attraction force therebetween will overcome the repulsive force between the first magnetic member 11 and the third magnetic member 13, and attract the third magnetic member 13 to move towards the locking tongue 21, so that the locking portion 141 moves towards the locking tongue 21 and is locked into the groove portion 212 of the locking tongue 21, thereby making the male buckle 20 and the locking tongue 21 of the female buckle 10 are connected together.

When it is necessary to unlock, pull the pull rope 144 or the pull ring to move the locking portion 141 in the direction of exiting the fixing hole 151 to withdraw from the groove portion 212 of the locking tongue 21, so that the male buckle 20 and the female buckle 10 can separate from each other to achieve unlocking.

Embodiment 2

The basic structure of this embodiment is the same as that of embodiment 1, the difference is that in the default state, the first magnetic member 11 and the third magnetic member 13 repel each other so that the locking portion 141 slightly protrudes within the range of the fixing hole 151.

When the male buckle 20 and the female buckle 10 are approached in the locking direction, the magnetic attraction force between the first magnetic member 11 and the second magnetic member 22 will cause the locking tongue 21 of the male buckle 20 to align with the locking hole 12 of the female buckle 10 and insert into it. During the insertion process, the locking tongue 21 pushes the locking portion 141 away and continues to move forward in the locking direction. When the locking tongue 21 enters the locking hole 12, the second magnetic member 22 and the third magnetic member 13 attract each other, and the attraction force therebetween will overcome the repulsive force between the first magnetic member 11 and the third magnetic member 13 to attract the third magnetic member 13 moves towards the locking tongue 21, so that the locking portion 141 moves towards the locking tongue 21 and is locked into the groove portion 212 of the locking tongue 21, thereby making the male buckle 20 and the locking tongue 21 of the female buckle 10 connected together.

When it is necessary to unlock, pull the pull rope 144 or the pull ring to move the locking portion 141 in the direction of exiting the fixing hole 151 to withdraw from the groove portion 212 of the locking tongue 21, so that the male buckle 20 and the female buckle 10 can separate from each other to achieve unlocking.

Embodiment 3

The basic structure of this embodiment is the same as that of the first embodiment. The difference is that the third magnetic member 13 is different from the first magnetic member 11 and the second magnetic member 22 in terms of magnetic arrangement.

In this embodiment, the third magnetic member 13 attracts the first magnetic member 11; when the locking tongue 21 enters the locking hole 12, the third magnetic member 13 repels the second magnetic member 22, and the attractive force between the third magnetic member 13 and the first magnetic member 11 is greater than the repulsive force between the second magnetic member 22 and the first magnetic member 11.

As shown in 5A of FIG. 5, in the default state, the first magnetic member 11 and the third magnetic member 13 attract each other so that the locking portion 141 is within the range of the fixing hole 151.

When the male buckle 20 and the female buckle 10 are approached in the locking direction, the magnetic attraction force between the first magnetic member 11 and the second magnetic member 22 will cause the locking tongue 21 of the male buckle 20 to align with the locking hole 12 of the female buckle 10 and insert into it. As shown in 5B of FIG. 5, during the insertion process, the magnetic attraction force between the first magnetic member 11 and the second magnetic member 22 will cause the locking tongue 21 to push the locking portion 141 away and continue to move forward in the locking direction. As shown in 5C of FIG. 5, when the locking tongue 21 completely enters the locking hole 12 reaching the locked position, the magnetic attraction force between the third magnetic member 13 and the first magnetic member 11 is greater than the magnetic repulsion force between the third magnetic member 13 and the second magnetic member 22, and it will attract the third magnetic member 13 to move toward the locking tongue 21, so that the locking portion 141 moves toward the locking tongue 21 to be locked into the groove portion 212 of the locking tongue 21, in turn, the male buckle 20 and the locking tongue 21 of the female buckle 10 are connected together.

When it is necessary to unlock, pull the pull rope 144 or the pull ring to move the locking portion 141 in the direction of exiting the fixing hole 151 to withdraw from the groove portion 212 of the locking tongue 21, so that the male buckle 20 and the female buckle 10 can separate from each other to achieve unlocking.

When unlocked, after the male buckle 20 is separated from the female buckle 10, the first magnetic member 11 and the third magnetic member 13 attract each other to actuate the locking member 14 to reset, so that the locking portion 141 protrudes within the range of the fixing hole 151.

Embodiment 4

As shown in FIG. 6, FIG. 7, and FIG. 8, the structure of the male buckle 20 in this embodiment is the same as that in Embodiment 1, and will not be repeated in this embodiment.

As shown in FIGS. 6, 7, and 8, the female buckle 10 of this embodiment includes a housing 15, a locking member 14, a first magnetic member 11 and a third magnetic member 13.

The structure of the housing 15 and the first magnetic member 11 is the same as that of the first embodiment, and will not be repeated in this embodiment.

As shown in FIG. 6, FIG. 7, and FIG. 8, the locking member 14 is movably arranged in the housing 15. The locking member 14 is provided with a locking portion 141 and a mounting position 142 for installing the third magnetic member 13. The locking member 14 is provided with a through hole corresponding to the fixing hole 151, and the locking portion 141 and the mounting position 142 are located on opposite sides of the through hole. In other words, the locking portion 141 and the third magnetic member 13 are respectively located on opposite sides of the fixing hole 151.

As shown in FIGS. 6, 7, and 8, the locking portion 141 is in the shape of a plate, and the end thereof facing the fixing hole 151 or the through hole is in the shape of an arc, and is used to hold the locking tongue 21, and can be locked in the groove portion 212 of the locking tongue 21. In order to facilitate the locking tongue 21 to push the locking portion 141 into the locking hole 12, the arc-shaped end of the locking portion 141 is provided with an introduction inclined curved surface 1411. The introduction inclined curved surface 1411 facilitates the squeezing of the locking tongue 21 and squeezes it into the locking hole 12, so that the locking portion 141 can lock the locking tongue 21.

As shown in FIG. 6, FIG. 7, and FIG. 8, the mounting position 142 has a groove structure, and the third magnetic member 13 can be clamped. The shape and size of the mounting position 142 should match the shape and size of the third magnetic member 13. In this embodiment, the mounting position 142 is a rectangular slot, which can be used to hold a rectangular magnet block.

As shown in FIG. 6, in order to facilitate unlocking by actuating the locking member 14 by an external force, the locking member 14 may be provided with a corresponding operating part. In this embodiment, the locking member 14 is actuated to unlock by pulling outwards. Therefore, the locking member 14 is provided with a pull hole 143, which can be conveniently provided with a pull ring or a pull rope 144. When the pull ring or pull rope 144 is pulled outward, the locking portion 141 moves in a direction away from the fixing hole 151. In other embodiments, corresponding operating parts can be provided according to different unlocking operating manners, so as to facilitate the user's operation to activate the locking member 14 for unlocking.

As shown in FIG. 6, the third magnetic member 13 is disposed in the mounting position 142 of the locking member 14. The position of the third magnetic member 13 is fixed relative to the locking member 14. Since the locking member 14 is movably arranged in the housing 15, the third magnetic member 13 and the locking member 14 can move synchronously.

In this embodiment, the first magnetic member 11 and the second magnetic member 22 are circular magnets that attract each other. The third magnetic member 13 is a rectangular magnet that attracts the first magnetic member 11; when the locking tongue 21 enters the locking hole 12, the third magnetic member 13 repels the second magnetic member 22.

As shown in 9A of FIG. 9, in the default state, the first magnetic member 11 and the third magnetic member 13 attract each other so that the locking portion 141 is outside the range of the fixing hole 151.

When the male buckle 20 and the female buckle 10 are approached in the locking direction, the magnetic attraction force between the first magnetic member 11 and the second magnetic member 22 will cause the locking tongue 21 of the male buckle 20 to align with the locking hole 12 of the female buckle 10 and insert into it. Since the locking portion 141 is outside the range of the fixing hole 151, the locking tongue 21 can directly enter the locking hole 12 during the insertion process without pushing the locking portion 141, thereby particularly facilitating for inserting the male buckle 20 into the female buckle 10.

As shown in 9B of FIG. 9, when the locking tongue 21 enters the locking hole 12, the second magnetic member 22 and the third magnetic member 13 repel each other, and the repulsive force therebetween will overcome the attraction force between the first magnetic member 11 and the third magnetic member 13, and actuate the third magnetic member 13 to move away from the locking tongue 21, so that the locking portion 141 on the other side of the locking tongue 21 moves toward the locking tongue 21 to be locked into the groove portion 212 of the locking tongue 21, so that the male buckle 20 and the female buckle 10 are locked and connected together.

When it is necessary to unlock, pull the pull rope 144 or the pull ring to move the locking portion 141 in the direction of exiting the fixing hole 151 to withdraw from the groove portion 212 of the locking tongue 21, so that the male buckle 20 and the female buckle 10 can separate from each other to achieve unlocking.

When the unlocking is completed, after the locking tongue 21 of the male buckle 20 withdraws from the locking hole 12, the first magnetic member 11 and the third magnetic member 13 attract each other so that the locking member 14 remains the state that its locking portion 141 protrudes within the range of the hole 151.

Embodiment 5

The basic structure of this embodiment is the same as that of Embodiment 4, the difference is that the third magnetic member 13 is different from the first magnetic member 11 and the second magnetic member 22 in terms of magnetic arrangement.

In this embodiment, the third magnetic member 13 repels the first magnetic member 11; when the locking tongue 21 enters the locking hole 12, the third magnetic member 13 attracts the second magnetic member 22, and the repulsive force between the third magnetic member 13 and the first magnetic member 11 is greater than the attractive force between the second magnetic member 22 and the first magnetic member 11.

As shown in 10A of FIG. 10, in the default state, the first magnetic member 11 and the third magnetic member 13 repel each other so that the locking portion 141 is within the range of the fixing hole 151.

When the male buckle 20 and the female buckle 10 are approached in the locking direction, the magnetic attraction force between the first magnetic member 11 and the second magnetic member 22 will cause the locking tongue 21 of the male buckle 20 to align with the locking hole 12 of the female buckle 10 and insert into it. As shown in 10B of FIG. 10, during the insertion process, the magnetic attraction force between the first magnetic member 11 and the second magnetic member 22 will cause the locking tongue 21 to push the locking portion 141 away and continue to move forward in the locking direction. As shown in 10C of FIG. 10, when the locking tongue 21 completely enters the locking hole 12, the magnetic repulsion force between the third magnetic member 13 and the first magnetic member 11 is greater than the attraction force between the third magnetic member 13 and the second magnetic member 22, so that the third magnetic member 13 is moved in the direction away from the locking tongue 21, further the locking portion 141 located on the other side of the locking tongue 21 moves toward the locking tongue 21 and is locked into the groove portion 212 of the locking tongue 21, realizing the locking connection of the male buckle 20 and the female buckle 10.

When it is necessary to unlock, pull the pull rope 144 or the pull ring to move the locking portion 141 in the direction of exiting the fixing hole 151 to withdraw from the groove portion 212 of the locking tongue 21, so that the male buckle 20 and the female buckle 10 can separate from each other to achieve unlocking.

After unlocking, when the male buckle 20 is separated from the female buckle 10, the first magnetic member 11 and the third magnetic member 13 repel each other and can actuate the locking member 14 to reset, so that the locking portion 141 remains within the range of the fixing hole 151.

Although the present invention has been disclosed through the above embodiments, the scope of the present invention is not limited thereto. Without departing from the concept of the present invention, the above components can be replaced with similar or equivalent elements understood by those skilled in the art.

What is claimed is:

1. A magnetic buckle, including:

a female buckle (10), provided with a first magnetic member (11);

a male buckle (20), provided with a second magnetic member (22);

the second magnetic member (22) and the first magnetic member (11) attracted to each other in a locking direction of the male buckle (20) and the female buckle (10), and the male buckle (20) and the female buckle (10) can be mated and locked together in the locking direction;

characterized in that, the female buckle (10) is provided with a locking member (14) that can lock the male buckle (20) so that the male buckle (20) and the female buckle (10) are locked and connected together, the locking member (14) is provided with a third magnetic member (13), and the third magnetic member (13) can be interact with the second magnetic member (22) and/or the first magnetic member (11) through magnetic force so that it can actuate the locking member (14) to lock the male buckle (20) when the male buckle (20) is mated with the female buckle (10).

2. The magnetic buckle according to claim 1, characterized in that:

the male buckle (20) is provided with a protruding locking tongue (21);

the female buckle (10) is provided with a fixing hole (151) for free entry and exit of the locking tongue (21);

the locking member (14) is provided with a locking portion (141) that can protrude within a range of the fixing hole (151) so as to lock the locking tongue (21);

when the locking tongue (21) is inserted into the fixing hole (151), the third magnetic member (13) interacts with the second magnetic member (22) and/or the first magnetic member (11) through the magnetic force so that it can actuate the locking portion (141) to protrude within the range of the fixing hole (151) so as to lock the locking tongue (21).

3. The magnetic buckle according to claim 2, characterized in that the third magnetic member (13) and the first magnetic member (11) can attract or repel each other so that the locking portion (141) can protrude within the range of the fixing hole (151) when the male buckle (20) and the female buckle (10) are in a separated state.

4. The magnetic buckle according to claim 2, characterized in that the third magnetic member (13) and the locking portion (141) are arranged on a same side of the fixing hole (151).

5. The magnetic buckle according to claim 4, characterized in that:

the third magnetic member (13) and the first magnetic member (11) repel each other;

when the locking tongue (21) enters the fixing hole (151), the second magnetic member (22) attracts the third magnetic member (13) to make the locking portion (141) move towards the locking tongue (21) to lock the locking tongue (21).

6. The magnetic buckle according to claim 4, characterized in that:

the third magnetic member (13) attracts the first magnetic member (11) to make the locking portion (141) protrude within the range of the fixing hole (151) when the male buckle (20) and the female buckle (10) are in a separated state;

when the locking tongue (21) enters the fixing hole (151), a force of the second magnetic member (22) attracting the first magnetic member (11) and repelling the third magnetic member (13) can cause the locking tongue (21) to push the locking portion (141) to move in the locking direction; when the locking tongue (21) moves to a locked position along the locking direction, the first magnetic member (11) and the third magnetic member (13) are attracted to make the locking portion (141) move towards the locking tongue (21) to lock the locking tongue (21).

7. The magnetic buckle according to claim 2, characterized in that the third magnetic member (13) and the locking portion (141) are arranged on opposite sides of the fixing hole (151).

8. The magnetic buckle according to claim 7, characterized in that:

the third magnetic member (13) and the first magnetic member (11) are attracted to each other so that the locking portion (141) is located outside the range of the fixing hole (151) when the male buckle (20) and the female buckle (10) are in a separated state;

when the locking tongue (21) enters the fixing hole (151), the second magnetic member (22) repels the third magnetic member (13) so that the locking portion (141) moves towards the locking tongue (21) to lock the locking tongue (21).

9. The magnetic buckle according to claim 7, characterized in that:

the third magnetic member (13) repels the first magnetic member (11), so that the locking portion (141) protrudes within the range of the fixing hole (151) when the male buckle (20) and the female buckle (10) are in a separated state;

when the locking tongue (21) enters the fixing hole (151), a force of the second magnetic member (22) attracting the first magnetic member (11) and the third magnetic member (13) can cause the locking tongue (21) to push the locking portion (141) to move in the locking direction; when the locking tongue (21) moves in the locking direction to a locked position, the first magnetic member (11) and the third magnetic member (13) repel each other so that the locking portion (141) can move towards the locking tongue (21) to lock the locking tongue (21).

10. The magnetic buckle according to claim 1, characterized in that the third magnetic member (13) and the first magnetic member (11) can attract or repel each other, and actuate the locking member (14) to reset when the male buckle (20) and the female buckle (10) are separated from each other.

11. The magnetic buckle according to claim 1, characterized in that the locking member (14) is a rigid structure, and a position of the third magnetic member (13) relative to the locking member (14) is fixed.

* * * * *